United States Patent [19]

Queener

[11] 4,084,897

[45] Apr. 18, 1978

[54] HALF-LENS/MIRROR COPIER PROVIDING ORIGINAL-TO-COPY IMAGE REDUCTION

[75] Inventor: Carl Allan Queener, Boulder, Colo.

[73] Assignee: International Business Machines Corporation, Armonk, N.Y.

[21] Appl. No.: 754,808

[22] Filed: Dec. 27, 1976

[51] Int. Cl.[2] ..... G03G 15/28

[52] U.S. Cl. ..... 355/8; 355/11; 355/60

[58] Field of Search ..... 355/8, 11, 14, 47–51, 355/66, 55, 60

[56] References Cited

U.S. PATENT DOCUMENTS

| | | | |
|---|---|---|---|
| 3,614,222 | 10/1971 | Post et al. | 355/8 |
| 4,018,523 | 4/1977 | Hughes | 355/8 |
| 4,029,409 | 6/1977 | Spinelli et al. | 355/11 X |

*Primary Examiner*—Richard L. Moses
*Attorney, Agent, or Firm*—Francis A. Sirr

[57] ABSTRACT

A half-lens/mirror type copier having object-plane to image-plane reduction. The copier's scanning mechanism includes first and second moving mirrors. The first mirror line-scans a stationary original document to be copied. The second mirror receives the document's image, which is reflected from the first mirror, and directs this image to a half-lens/mirror. The half-lens/-mirror's optical axis is located off-axis of the image received from the second mirror, and directs this image onto a stationary mirror. The stationary mirror directs the image onto the copier's moving photoconductor.

The scanning mechanism can be parked at an end-of-scan position, and the original document is then moved past the stationary scanning mechanism, to thereby direct the document's image onto the copier's moving photoconductor.

In order to achieve reduction, in either the scanning mode or the parked mode, the copier is initialized by moving second mirror and the half-lens/mirror a disclosed distance.

7 Claims, 5 Drawing Figures

HALF-LENS/MIRROR COPIER PROVIDING ORIGINAL-TO-COPY IMAGE REDUCTION

BACKGROUND AND SUMMARY OF THE INVENTION

Object-plane to image-plane reduction is well known in optical scanning copiers, of which U.S. Pat. No. 3,614,222 is an example. Half-lens/mirror copiers, with and without reduction, are shown, for example, in U.S. Pat. Nos. 3,535,037; 3,543,289; 3,545,857; 3,572,927; 3,720,466 and 3,832,057.

Dual mode copiers are also known, wherein in a first or scanning mode a stationary original document is line-scanned by moving the appropriate optical elements, and wherein in the second or parked-optics mode, the optical elements are locked in a predefined position and the original is moved past a scanning line at a speed equal to the copier's photoconductor speed. U.S. Pat. Nos. 3,877,804; 3,900,258; 3,909,128 and 3,944,365 show such dual mode copiers of the half-lens/mirror type.

The present invention provides object/plane to image-plane reduction in a half-lens/mirror type copier wherein the difficult problem of off-axis orientation of the half-lens/mirror is solved by unique displacement of one of the scanning mirrors and of the half-lens/mirror. Reduction in an off-axis half-lens/mirror copier is provided by an analysis of such a copier, and the deduction that certain unexpected and unique movements are required in order to provide reduction.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
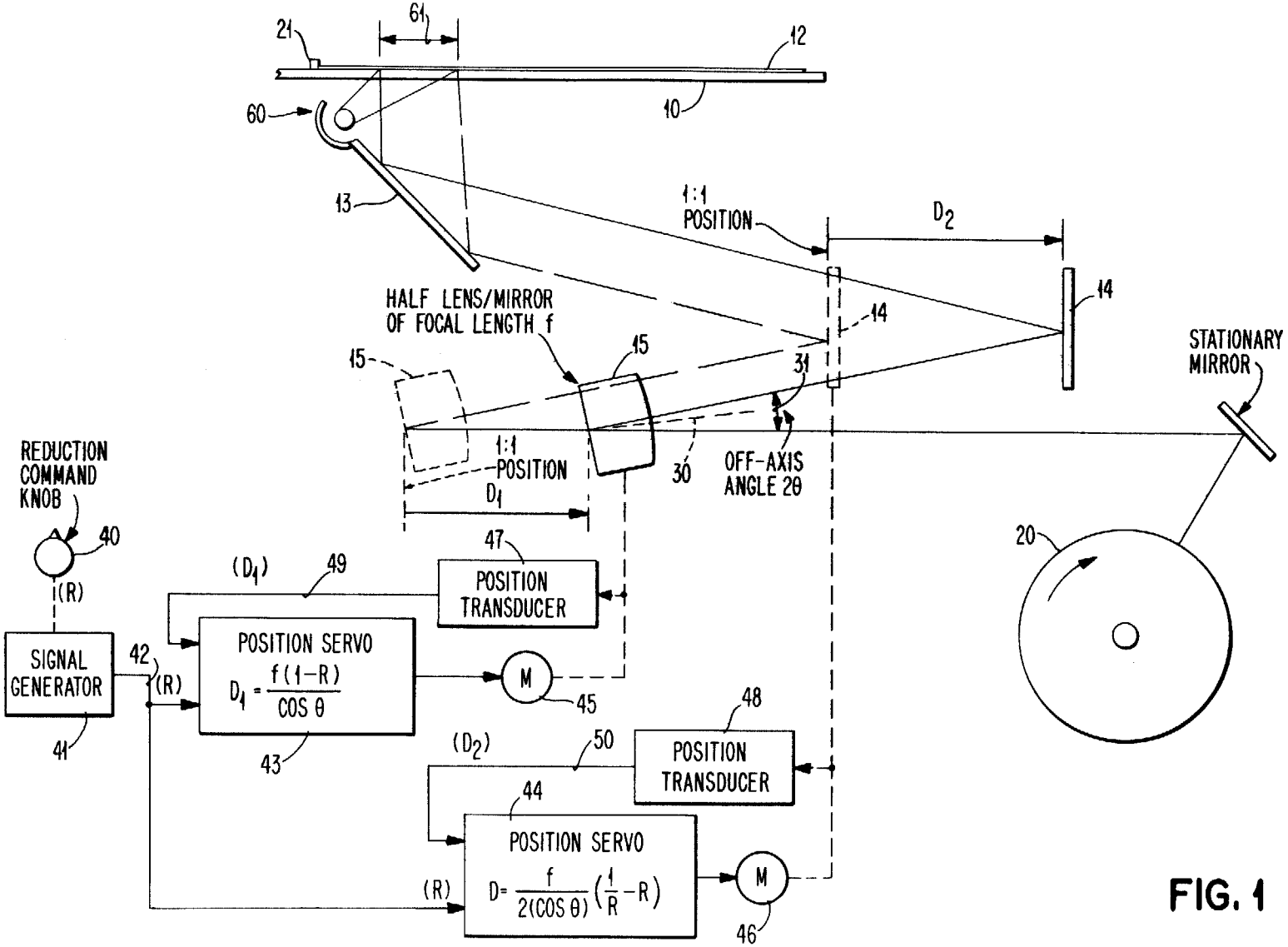
FIG. 1 is a diagrammatic view of a scanning xerographic copier embodying the present invention.

Referring to FIG. 1, this scanning copier apparatus is constructed and arranged to place a flowing line image of a stationary original document, supported upon platen 10, upon the photoconductor of rotatable drum 20. The platen is constructed of clear glass and is mounted within the copier's frame (not shown) to provide a horizontal document viewing station. A guide 21 is provided to aid in document positioning. A flat original document 12 is shown positioned upon the platen, in contact with guide 21.

Scanning of the original document is accomplished by a first scanning mirror 13 and a second scanning mirror 14. Mirrors 13 and 14 are supported upon carriages (not show) which are adapted to move back and forth over a prescribed horizontal path, below the platen's surface. Mirror 13 extends transversely across the platen substantially parallel with guide 11. Mounted above and to the left of mirror 13, on the carriage holding this mirror, is a lamp and a reflector 60 which cooperate to illuminate a longitudinally extending incremental platen area of width 61, within view of mirror 13. The carriage holding this lamp, its reflector and mirror 13 is adapted to move across the lower surface of the platen at a constant speed whereby mirror 13 scans successive illuminated line-image areas. The scan of start begins at approximately guide 21 and terminates at the opposite side of the platen.

A second movable carriage (not shown) supports mirror 14. Mirror 14 is positioned to receive light reflected from mirror 13 and redirects this light toward the stationary half-lens/mirror optical device 15 having a focal length f. The light entrance/exit face of this optical device is positioned off its central optical axis 30 so as to receive light rays directed thereto from mirror 14. A mirror reflecting surface is positioned at the lens stop and operates to reverse the received light rays as they pass through the lens components, thus simulating a conventional symmetrical system. This system provides an off-axis lens which collects light from one side of its central optical axis 30, and transmits the received image on the opposite side of this axis. The angle 31 is defined as $2\theta$, or twice the off-axis angle.

At the initiation of a copying cycle, mirrors 13 and 14 are both in their respective home or base positions. To start a copying cycle, drum 10 begins to rotate at a constant speed and a flowing-line image of the original document is presented to the photoconductor.

As is well known, for 1-to-1 copying of the original document, the scan speed of mirror 13 is equal to the peripheral speed of drum 10, and the scan speed of mirror 14 is one-half this speed.

Further details as to the construction of FIG. 1's optical scanning system can be found in U.S. Pat. No. 3,832,057, incorporated herein by reference. The structure of this patent can be modified by the addition of an original document feeder 70 diagrammatically shown in FIG. 2, to thereby selectively provide either scanning of a stationary original document (FIG. 1), or parked-optics line-imaging of a moving original document (FIG. 2), as described in U.S. Pats. Nos. 3,877,804; 3,900,258; 3,909,128 and 3,944,365, incorporated herein by reference. The FIG. 2 parked optics, moving original document mode of operation is intended for use with large original documents.

With reference to FIG. 1, when the object plane-to-image plane reduction ratio R is to be 1, i.e., a 1-to-1 ratio between the original document and its copy, the speed of mirror 13 equals that of drum 10. As is well known, when reduction is effected, the speed of mirrors 13 and 14 is increased proportionately. For example, a well known reduction request is to reduce computer printout onto an $8\frac{1}{2} \times 11$ inch sheet of copy paper. In this case, the reduction ratio is $11/14.85 = 0.74$. Thus, the speed of mirrors 13 and 14 is increased by the multiplier $1/.74 = 1.35$. The dotted position of mirror 14 is the scan position for this mirror in the 1-to-1 mode at some arbitrary position within the scan, and the dotted position of lens device 15 is its fixed position for 1-to-1 reproduction. As will be apparent, these are the base positions from which the later defined distances $D_1$ and $D_2$ are measured.

Figure 2:
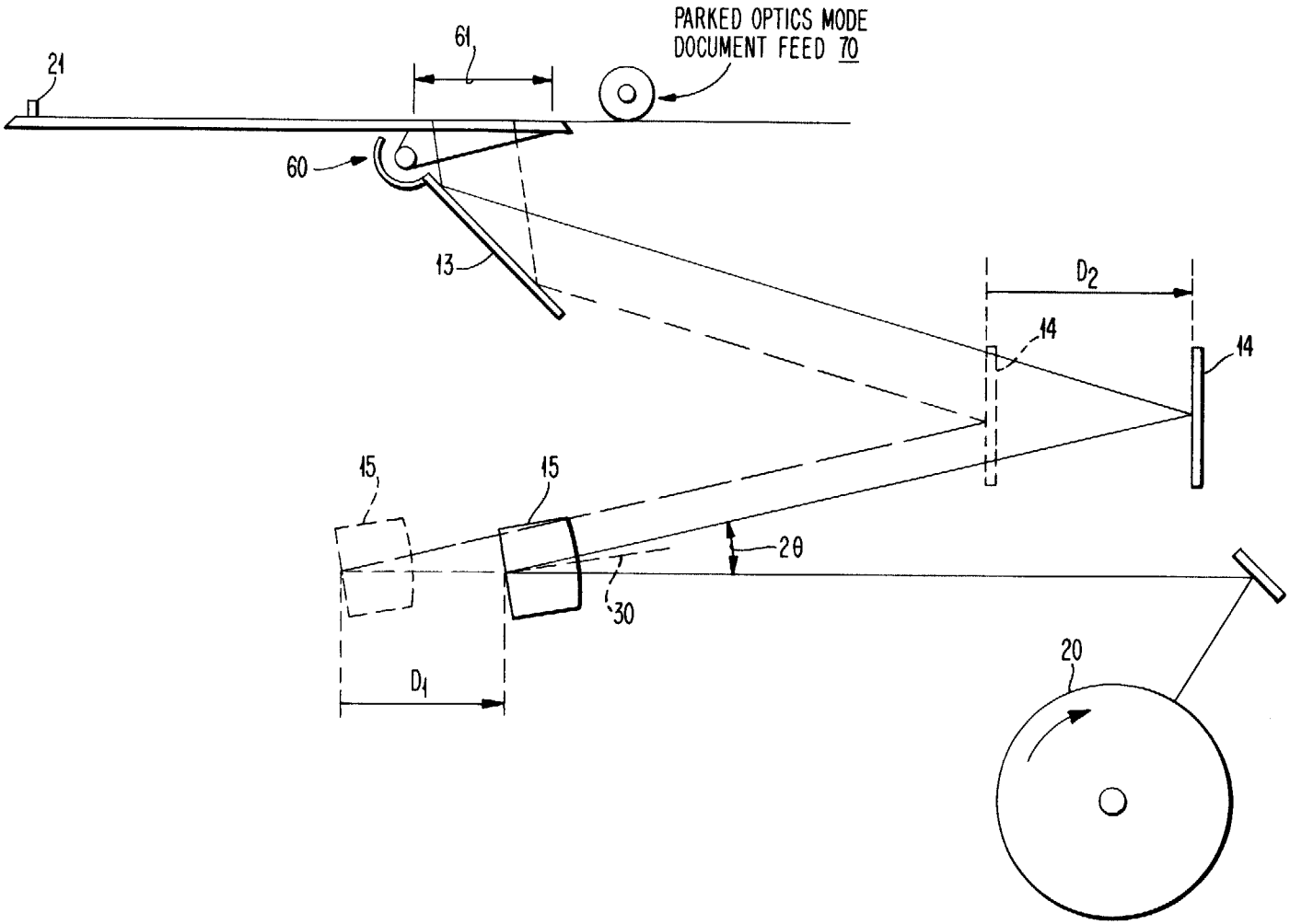
FIG. 2 is a diagrammatic view of the copier shown in FIG. 1, with the parked optics/moving original document feature, this copier likewise including, but not showing, the servos of FIG. 1.

With reference to FIG. 2, when the object plane-to-image plane reduction ratio R is to be 1, the optics means 13, 14 of FIG. 1 are parked adjacent the end of scan, to FIG. 2's full-line position 13 and dotted-line position 14. All of the elements 13, 14, 15 (dotted-line position) remain stationary in this position as document feed 70 moves the document through scan area 61, at a speed equal to the speed of photoconductor 20, for the stated 1-to-1 mode. The dotted-line positions of 14 and 15 are the base positions from which the later defined distances $D_1$ and $D_2$ are measured, as will be apparent.

When the copier of FIG. 1 or 2 is to provide image reduction, the speed of the moving mirrors (FIG. 1), or the moving original document (FIG. 2) must be changed, as is well known in the art. Specifically, this speed change is as expressed by the following formula, assuming of course that photoconductor speed does not change, as is the usual case:

$$\frac{\text{speed of mirror 13 - or - moving document}}{\text{speed of photoconductor}} = \frac{1}{R}$$

The present invention provides a manual control knob 40 whose position is indicative of the desired reduction ratio R. As is well known in the art, adjustment of this knob operates, by means not shown, to effect the above-described change in the speed of mirrors 13 and 14 (FIG. 1) or change in speed of the original document (FIG. 2), as by means of a speed-variable coupling between drum 10 and the carriages which support mirrors 13 and 14 or the original document drive means of FIG. 2.

Adjustment of knob 40 also accomplishes initializing adjustment of FIG. 1 and 2's mirror 14 and lens device 15 from the dotted-line positions in accordance with the present invention, prior to beginning of the copying process. Specifically, knob 40 controls signal generator 41 so as to generate a linear DC control signal on conductor 42, the magnitude of which increases as a function of R. This control signal is applied as a position command signal to the input of electronic lens position servo 43, and electronic mirror position servo 44. Servo 43 is constructed and arranged to implement the closed loop position servo equation $D_1 = f(1-R)/\text{Cos}\,\theta$, where $D_1$ is the lens' movement distance to the right as shown in FIGS. 1 and 2. Servo 44 is constructed and arranged to implement the closed loop position servo equation $D_2 = (f/2\ \text{Cos}\ \theta)(1/R - R)$, where $D_2$ is the mirror 14's movement to the right as shown in FIGS. 1 and 2.

Specific servo details are not shown since feedback position servos of this type can take many forms, depending upon the preferences of those skilled in the art. Exemplary teachings as to the construction of such position servos may be found, for example, in *Servomechanisms and Regulating System Design, Volume* 1, by H. Chestnut and R. W. Mayer, John Wiley & Sons, Inc., 1951.

The output of each servo is presented to control rotation of a reversible DC motor 45 or 46. As a result of motor movement, position transducers 47 and 48 originate position feedback DC signals 49 and 50, respectively. These signals are linear functions of movements $D_1$ and $D_2$, respectively, and serve the purpose of causing motors 45 and 46 to continue rotation until lens 15 and mirror 14 are positioned as commanded by knob 40 and its position command signal 42(R).

One such adjusted position is shown in FIGS. 1 and 2 by the full-line position of lens 15 and mirror 14. Once knob 40 has been adjusted, and the required $D_1$ and $D_2$ movements have been accomplished, copying may proceed as above described.

Continuously adjustable knob 40 provides continuously variable reduction. If discrete reduction values are desired, push buttons may be substituted for knob 40, each button defining a different desired reduction value.

Figure 3:
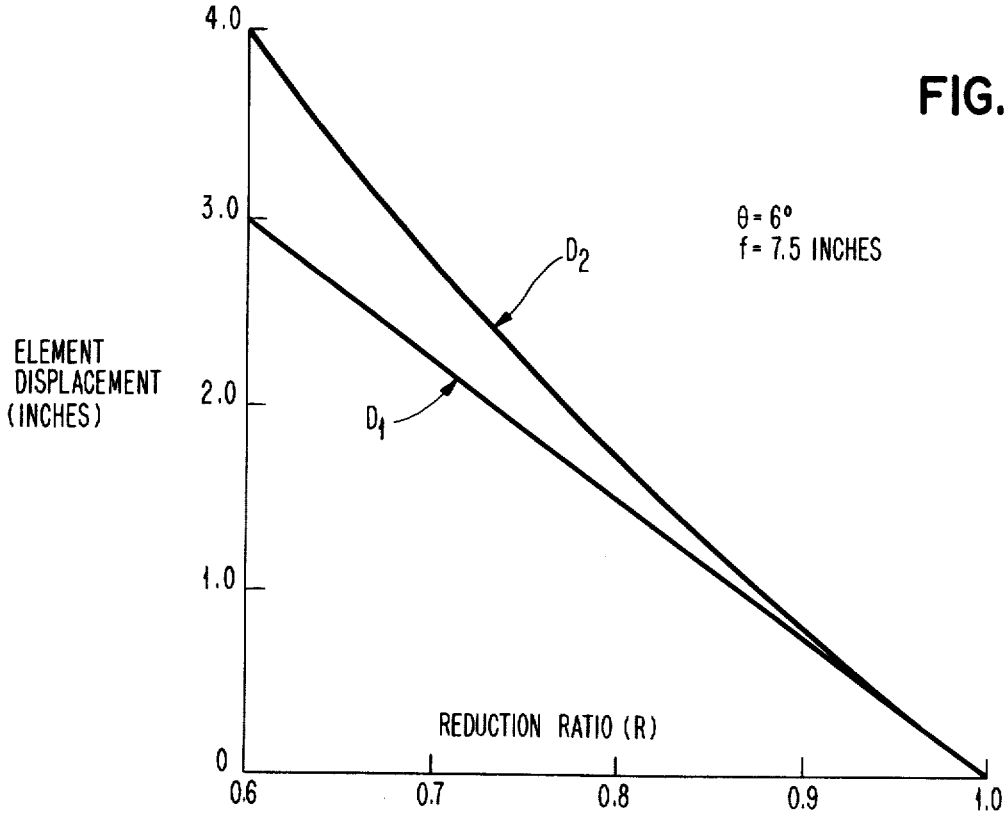
FIG. 3 shows curves depicting the closed loop position control achieved by FIGS. 1 and 2's lens position servo and mirror position servo for an exemplary device, i.e., an off-axis angle of 6° and a lens of 7.5 inches focal length.
Figure 4:
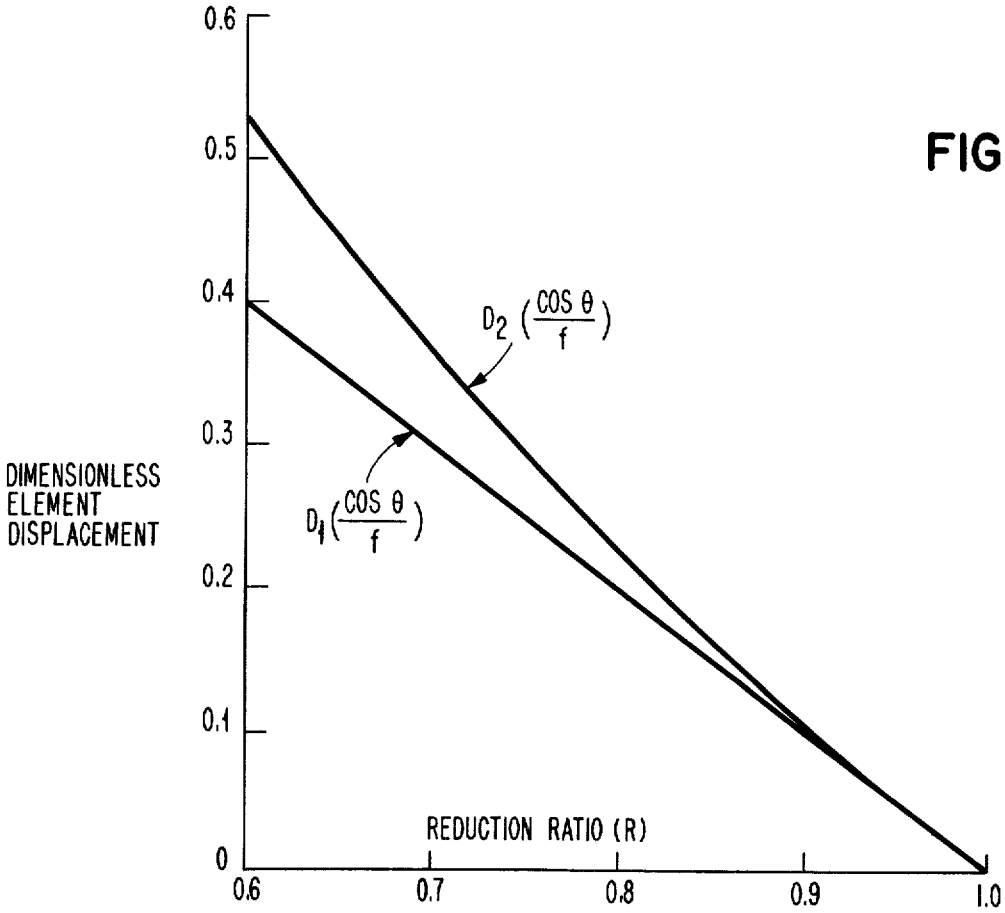
FIG. 4 is a dimensionless plot illustrating the basic behavior of the position functions implemented by FIGS. 1 and 2's lens position servo and mirror position servo with respect to the reduction ratio R.

FIG. 3 shows the R versus $D_1$ and $D_2$ movements, respectively, as achieved by servos 43 and 44, for an exemplary device having an off-axis angle of 6° and a lens of 7.5 inches focal length.

Figure 5:
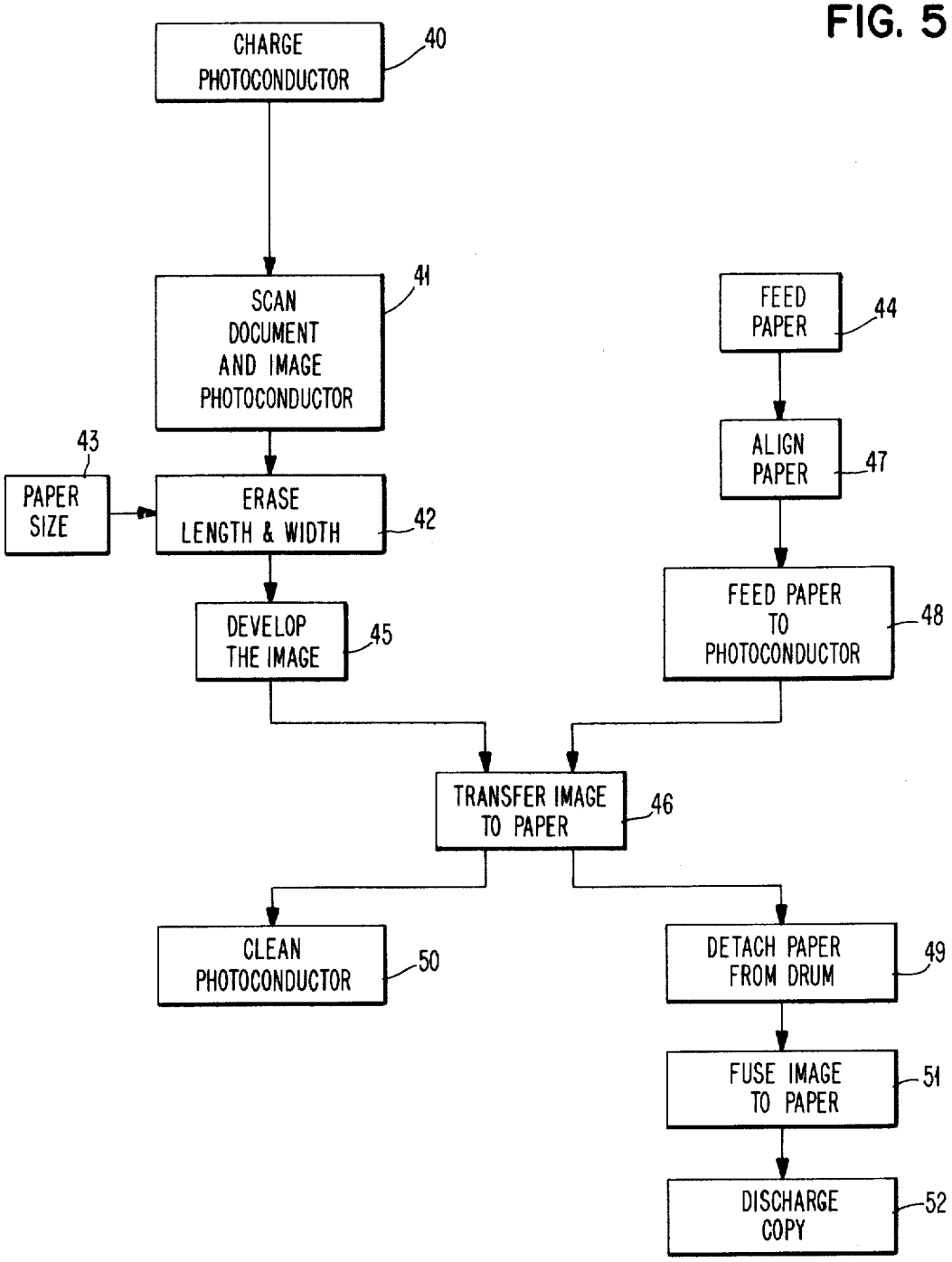
FIG. 5 is a block diagram representation of the xerographic process used in the copier of FIGS. 1 and 2.

The electrophotographic process used in this copier is well known and for this reason the various means operatively associated with FIGS. 1 and 2's photoconductor drum 20 have not been shown. This process is represented by FIG. 5, wherein charging of the photoconductor is represented by block 40. As represented by this block, a photoconductor surface, such as the photoconductor layer disposed on drum 20, is given a high, uniform electrostatic charge, for example, by being passed, in the absence of light, beneath a charge corona.

The next step in the process is represented by block 41, namely that of scanning an original document and projecting the image of this document onto the photoconductor. More specifically, the charged photoconductor is exposed to bright light reflected from an original document to be copied. The light reflected from the white parts of the document discharge corresponding areas of the photoconductor. The minimal light reflected from the original document's dark or printed areas fails to materially discharge the photoconductor. Consequently, an electrostatic latent image remains on those photoconductor areas which correspond to the dark or printed areas on original document of FIGS. 1 and 2.

The portion of the photoconductor corresponding to the area usable to contain an image of the original document can be defined as the photoconductor's working area. All portions of the photoconductor other than this working area must now be erased as represented by block 42. This erase function can be controlled, for example, in accordance with paper size, as indicated by 43, this being the specific size paper which is presently being utilized in the copier. A single sheet of this paper is, at about this same time, fed to the process, as indicated at 44.

After erase function 42 has been completed, the only remaining charged area, that is the only area having a charge magnitude sufficient to retain toner, is the latent image of the original document. This latent image is now passed through a developer, as represented by block 45. As a result of development, a reverse-reading visual toner image of the original document now resides on the photoconductor. During development step 45, the electrostatic latent image of the original document is coated with a pigmented powder or toner. This toner has an electrostatic charge of the opposite polarity to that of the photoconductor's charged areas. As a result, the toner particles adhere electrostatically to these charged areas, but do not adhere to the discharged or substantially uncharged areas.

The next step in the process is transfer step 46 whereat the photoconductor's toner image is transferred to the sheet of paper which was fed at step 44. However, prior to this sheet arriving at the transfer step, its leading edge is aligned at 47, and thereafter fed to the photoconductor in synchronism with arrival of the photoconductor's developed image, as at step 48.

During the transfer step, the photoconductor's developed image is transferred to the sheet by bringing the sheet substantially into contact with the photoconductor and by causing the toner to be transferred electrostatically from the photoconductor to the sheet.

After transfer is completed, the sheet is stripped from the photoconductor, as represented by step 49.

Since the photoconductor retains a residual toner image after transfer, the photoconductor must be cleaned, as at block 50. During this cleaning step, residual toner is removed from the photoconductor, thereby preventing this residual toner from interferring with reuse of the same photoconductor area for copying of the same or a different original document.

In order to complete the copy process, the toner, now carried by the paper sheet, is fused to the paper, as at step 51. Thereafter the finished copy is discharged from the copier, as at block 52.

While the position servos disclosed herein are closed-loop servos of the well known electronic type, it is contemplated that the term "position servo", as used herein, is defined more broadly, so as to encompass both open and closed loop servos, and those which, for example, are fully equivalent mechanical devices employing cams, levers and the like to effect movement defined by the equations $D_1 = f(1-\mathbf{R})/\text{Cos}\ \theta$ and $D_2 = (f/2\ \text{Cos}\ \theta)(1/R - R)$.

As will be readily apparent to one of skill in the art, not only is the present invention of utility relative to a scanning optics or a parked optics half-lens/mirror copier, as above described, but also, the original document may be either center referenced or corner referenced. By definition, center referencing is where original documents are centered on FIG. 1's guide 21 or as they pass through FIG. 2's document feed 70. Corner referencing is where original documents have a common corner, such as a corner at the front-left of FIGS. 1 and 2. If corner referencing is selected, then as is well known, half-lens/mirror 15 must be additionally moved normal to direction $D_1$ as reduction is effected. However, the magnitude of the $D_1$ movement, as above defined, is not changed.

While the invention has been particularly shown and described with reference to preferred embodiments thereof, it will be understood by those skilled in the art that various changes in form and details may be made therein without departing from the spirit and scope of the invention.

What is claimed is:

1. In a half-lens/mirror copier wherein a line-image of an original document is received by a mirror, and whose reflection thereafter proceeds to a half-lens/mirror, the half-lens/mirror reflected image then proceeding to a recording medium; the improvement comprising, means for effecting continuously variable reduction of said original document, including:

reduction command means operable to originate a position command signal indicative of a desired reduction;

a first position servo receiving as an input said position command signal, and having an output connected to said mirror to change its position along the axis of its received image, and away from said original document, in accordance with the formula $(f/2\cos\theta)\ (1/R - R)$, where $f$ is the focal length of said half-lens/mirror, $\theta$ is the off-axis angle of the system, and R is the desired reduction expressed as a fractional part of a 1 to 1 reproduction of said original; and a second position servo receiving as an input said position command signal, and having an output connected to said half-lens/mirror to change its operating position along the axis of its reflected image, and toward said recording medium, in accordance with the formula $f(1-R)/\cos\theta$.

2. The copier defined in claim 1 wherein the original to be copied remains stationary on a document glass during the reproduction cycle and said mirror is scanned at a velocity defined by the formula:

$$\frac{2 \times \text{mirror speed}}{\text{recording medium speed}} = \frac{1}{R}.$$

3. The copier defined in claim 1 wherein the components of the imaging/optics system do not move during the reproduction cycle and the original document to be copied is moved at a speed defined by the formula:

$$\frac{\text{document speed}}{\text{recording medium speed}} = \frac{1}{R}.$$

4. A continuously variable reduction imaging system for an electrophotographic copier machine, wherein a document to be copied is typically of rectangular shape, comprising:

a transparent platen for supporting said document;

a constant speed movable photoconductor;

motive means for moving said photoconductor;

a source of illumination;

a document scanning system comprised of a scanning carriage for directing illumination from said source through said platen to said document;

means for moving said scanning carriage;

an optics system for directing illumination reflected from said document to produce an image on said photoconductor, said optics system including in sequential order from said document to said photoconductor, a scanning mirror and motive means to move said mirror, and a half-lens/mirror; and means for positioning said optic system to initialize said optics system for a desired reduction ratio, wherein said mirror and said half-lens/mirror are adjusted in a continuously variable manner;

whereby the reduction ratio of said imaging system is settable in a continuously variable manner;

said means for positioning said optics system being constructed and arranged (1) to effect movement of said half-lens/mirror along the axis of the reflected image of said document, in a direction toward said photoconductor, in accordance with the formula $f(1-R)/\cos\theta$, where $f$ is the focal length of said half-lens/mirror, R is the desired reduction ratio, and the angle $\theta$ is one-half of the off-axis angle of said half-lens/mirror; and (2) to effect movement of said scanning mirror along the axis of the light reflected from said document, in a direction away from said document, in accordance with the formula:

$$f/2\cos\theta(1/R - R).$$

5. The copier machine defined by claim 4 wherein said scanning carriage moves at a given speed and said scanning mirror moves at one-half said given speed, said given speed being defined by the formula:

$$\frac{\text{given speed}}{\text{recording medium speed}} = \frac{1}{R}.$$

6. A continuously variable reduction imaging system for an electrophotographic copier machine, wherein a document to be copied is typically of rectangular shape, comprising:

a transparent window for supporting a movable document;

a constant speed movable photoconductor;

motive means for moving said photoconductor;

a source of illumination;

a document illumination system;

means for moving said document past said window an optics system for directing illumination reflected from said document to produce an image on said photoconductor, said optics system including in sequential order from said document to said photoconductor, a mirror and a half-lens/mirror; and means for positioning said optics system to initialize said optics system for a desired reduction ratio, wherein said mirror and said half-lens/mirror are adjusted in a continuously variable manner;

whereby the reduction ratio of said imaging system is settable in a continuously variable manner;

said means for positioning system being constructed and arranged (1) to effect movement of said half-lens/mirror along the axis of the reflected image of said document, in a direction toward said photoconductor, in accordance with the formula $f(1-R)/\cos\theta$, where $f$ is the focal length of said half-lens/mirror, R is the desired reduction ratio, and the angle $\theta$ is one-half of the off-axis angle of said imaging system; and (2) to effect movement of said mirror along the axis of the light reflected from said document, in a direction away from said document, in accordance with the formula:

$$f/2\cos\theta(1/R-R).$$

7. The copier machine defined by claim 6 wherein said original document moves at a speed defined by the formula:

$$\frac{\text{document speed}}{\text{recording medium speed}} = \frac{1}{R}.$$

* * * * *